United States Patent [19]

Fong

[11] 3,998,707

[45] Dec. 21, 1976

[54] CADMIUM ELECTROPLATING PROCESS AND BATH THEREFOR

[75] Inventor: Jaan-Jiue Fong, Tolland, Conn.

[73] Assignee: Minnesota Mining & Manufacturing Company, St. Paul, Minn.

[22] Filed: July 14, 1975

[21] Appl. No.: 595,347

[52] U.S. Cl. ..... 204/50 R

[51] Int. Cl.[2] ..... C25D 3/26

[58] Field of Search ..... 204/50 R, 43 R, 44, 204/DIG. 2, 114; 106/1

[56] References Cited

UNITED STATES PATENTS

| | | | |
|---|---|---|---|
| 2,893,934 | 7/1959 | Westbrook | 204/50 R |
| 3,577,327 | 5/1971 | Joachim et al. | 204/50 R |
| 3,826,722 | 7/1974 | Accaries et al. | 204/50 R |

FOREIGN PATENTS OR APPLICATIONS

| | | | |
|---|---|---|---|
| 1,204,806 | 9/1970 | United Kingdom | 204/50 R |
| 184,089 | 9/1966 | U.S.S.R. | 204/50 R |

*Primary Examiner*—G. L. Kaplan

*Attorney, Agent, or Firm*—Alexander, Sell, Steldt & DeLaHunt

[57] ABSTRACT

An aqueous cadmium electroplating bath containing cadmium ions, sulfuric and/or fluoboric free acid and a surfactant comprised of a combination of a cationic polyoxyalkylated amine compound and an anionic surfactant. Preferably, the bath also contains one or more brighteners.

13 Claims, No Drawings

CADMIUM ELECTROPLATING PROCESS AND BATH THEREFOR

BACKGROUND OF THE INVENTION

A variety of electrolytic baths for electroplating cadmium on metallic substrates have been employed in the past. These baths typically utilize sulfates and cyanides as the primary electrolytes therein. Cyanide baths, while proving effective in a commercial sense, have significant objectionable features, not the least of which are toxicity of the bath components and difficulty of waste disposal due to the cyanide ion therein.

Heretofore available sulfate-based baths, while overcoming many of the objectionable features of the cyanide baths, have been found to exhibit relatively low throwing power and poor efficiency at low current densities, resulting in an increase of metal in the bath upon continued bath operation. Furthermore, most of the sulfate-based baths contain such components as ammonium ions and chelating agents. Such components, because of their ability to complex with heavy metal ions, significantly increase the difficulty of eliminating heavy metals from spent baths.

A chloride based cadmium bath, which has overcome many of the problems of the sulfate baths, and has been popular commercially, is disclosed in U.S. Pat. No. 3,577,327. However, this bath also contains ammonium ions and chelating agents, e.g. ethylenediaminetetracetic acid (EDTA), nitriloacetic acid (NTA) and citric acid in the bath. Thus, removal of heavy metals from spent baths is similarly difficult and expensive waste treatment procedures and equipment must be utilized.

In U.S. Pat. No. 3,826,722 there is disclosed an acid cadmium sulfate bath which does not contain ammonium ions or chelating agents therein. However, the effectiveness of the bath is dependent upon the inclusion of a thiosemicarbazone constituent. It is believed that this compound is somewhat unstable in strong acid solutions, and upon continued use in an electrolytic bath may result in cadmium deposits which are dull in appearance over an appreciable cathode current density range. Sulfur contamination of the bath from breakdown of this thiosemicarbazone compound on extended use can also prevent bright-dipping of the work piece subsequent to cadmium deposition.

SUMMARY OF THE INVENTION

In accordance with the invention, there is provided an aqueous acidic electrolytic bath composition suitable for electroplating cadmium on a metal-surfaced substrate comprising about 5 to about 75 grams per liter of cadmium ion, a free acid selected from the group consisting of sulfuric and fluoboric acids or mixtures thereof at a concentration of from about 0.4N to about 4.0N, and a surfactant combination comprising about 0.5 to about 20.0 grams per liter of a cationic polyoxyalkylated amine and about 0.5 to about 10.0 grams per liter of an anionic surfactant. Preferably, the bath also contains from about 0.05 to about 2.0 grams per liter of at least one non-sulfur containing brightener.

The present bath eliminates the necessity for objectionable ammonium ion and/or chelating agents thereby simplifying waste treatment procedures for heavy metal removal. Utilization of the preferred components in the invention provides a bath exhibiting high cathode current efficiency and superior bright throwing power in recessed areas of the cathode. The bath is capable of producing bright, smooth, fine-grained cadmium deposits over a wide cathode current density range upon continued electrolysis.

DETAILED DESCRIPTION OF THE PREFERRED EMBODIMENT

As previously noted, the components which are essential for satisfactory operation of the bath of the present invention to provide smooth, fine-grained, relatively bright cadmium deposits include cadmium ions, a free acid, and the surfactant combination.

The bath may contain from about 5 to about 75 grams per liter of cadmium ion, and preferably contains about 8 to about 55 grams per liter. Cadmium ion concentrations higher than about 75 grams per liter may tend to produce a coarse, grainy and spongy deposit at low cathode current densities, whereas baths containing less than about 5 grams of cadmium ion per liter result in hazy, non-uniform, non-bright deposits and exhibit low cathode current efficiency. The cadmium ion can be conveniently furnished from soluble cadmium sulfate or cadmium fluoborate salts or from cadmium oxide, the latter being capable of forming a soluble cadmium salt in combination with anions normally otherwise introduced.

The concentration of free acid selected from the group consisting of sulfuric and/or fluoboric may range from about 0.4N to about 4.0N with from about 0.75N to about 2.5N being preferred. Use of less than 0.4N acid concentration may produce a poorly conductive bath which is operative only over a narrow range of current density, thereby producing deposits of somewhat marginal quality. Raising the free acid concentration beyond about 4.0N provides minimal additional increase in current density, and at the same time may tend to provide reduced cathode current efficiency.

The cationic surfactants useful herein are polyoxyalkylated amines. Exemplary compounds within this class, and commercially available, include "Ethomeen" C-25, tradename for a tertiary amine having one coconut fatty alkyl group and two polyoxyethylene groups attached to the amino nitrogen, available from the Armak Company; "Polyrad" 1110, tradename for a dehydroabietylamine-ethylene oxide adduct, available from the Hercules Powder Company; and "Tetronic" 504, tradename for a polyoxypropylene/polyoxyethylene diamine, available from BASF Wyandotte Company. The concentration of cationic surfactants should be from about 0.5 grams per liter to about 20 grams per liter with from about 2.0 to about 15.0 grams per liter being preferred. Below about 0.5 grams per liter, the cadmium deposit tends to be coarse and dark, with no apparent grain refinement. At elevated concentrations, i.e. above about 20 grams per liter, the solubility limits of the surfactant in the bath may be exceeded.

The anionic surfactants useful herein in combination with the cationic surfactants hereinbefore defined include condensed naphthalene sulfonic acids or their corresponding salts, and long chain, i.e. at least 8 carbon atoms, alcohol sulfates.

The naphthalene sulfonates are formed from naphthalene and sulfonic acid, usually condensed in the presence of a lower aldehyde such as formaldehyde, and their molecular weight may vary considerably. The most useful sulfonates are those having a molecular weight of from about 400 to about 1,200 with from 600 to 900 being preferred.

Exemplary compounds falling within the above classes of materials, and commercially available, include "Lomar" NCO, tradename for the sodium salt of naphthalene sulfonic acid, available from the Diamond Shamrock Chemical Company; "Daxad" 11, tradename for a condensed naphthalene sulfonic acid, available from the W. R. Grace & Company; "Blanco", tradename for a condensed naphthalene sulfonic acid, available from the GAF Corporation; "Darvan" No. 1, tradename for a condensed naphthalene sulfonic acid, available from the R. T. Vanderbuilt Company; "Duponol" 80, tradename for the sodium salt of octyl alcohol sulfate, available from the EI DuPont Company; and "Duponol" SN, tradename for a mixture of sodium salts of long chain alcohol sulfates, available from the EI DuPont Company. The anionic surfactant should be present in a concentration of from 0.5 gram per liter to about 10.0 grams per liter with a range of 2.0 to 5.0 grams per liter being preferred. Below 0.5 gram per liter, the cadmium deposit tends to be coarse and dark with no apparent grain refinement. No advantage is gained by exceeding 10.0 grams per liter, and foaming of the bath becomes excessive.

The electrolytic bath of the present invention desirably and preferably includes non-sulfur containing organic brighteners to develop uniform specular brightness over a wide plating current density range. Brighteners which have been found to impart beneficial effects on the bath of the present invention include aryl aldehydes, e.g. anisic aldehyde, ring halogenated aryl aldehydes; e.g. orthochlorobenzaldehyde, 2,4-dichlorobenzaldehyde, and 2,6-dichlorobenzaldehyde; heterocyclic aldehydes, e.g. thiophene aldehyde; aryl olefinic-conjugated ketones, e.g. benzylidine acetone; and heterocyclic carboxylic acids, e.g. nicotinic acid and isonicotinic acid.

It has been determined that a combination or condensate of aminoguanidine bicarbonate and an aryl aldehyde can be utilized as a brightener herein. Aryl aldehydes such as ethyl vanillin, veratraldehyde, 2,5-dimethoxyl aldehyde, glutar aldehyde, tolyl aldehyde, etc., when admixed with aminoguanidine bicarbonate in the bath or when condensated therewith prior to being added to the bath impart full brightness to the cadmium deposit over a useful cathode current density range. Benzoylpyridine is another compound capable of use as a brightener herein.

The preferred brighteners are orthochlorobenzaldehyde, 2,4-dichlorobenzaldehyde and nicotinic acid. The brighteners may be employed singly or in combination within the concentration range of from about 0.05 gram per liter to about 2.0 grams per liter, and preferably from 0.1 gram per liter to about 1.0 grams per liter.

To extend the bright plating range at very low cathode current densities, e.g. at about 0.2 ampere per square decimeter, it may be desirable to include from about 0.2 gram per liter to about 2.0 grams per liter of additives such as beta-naphthol and 4-chloro-1-naphthol.

Bath temperatures generally range from about 15° to about 35° C with an optimum temperature being dependent on the type of plating being undertaken. At higher temperatures, the cathode current efficiency is good but somewhat dull deposits may be produced as the bright throwing power is reduced. Lower temperatures, below about 15° C, tend to reduce cathode current efficiency.

The invention will now be further exemplified by the following specific non-limiting examples of electrolytic solutions. Unless otherwise specified, all parts are by weight and a standard 267 ml Hull cell was utilized at bath temperatures of 22° to 24° C with a 3 ampere cathode current for 3 minutes.

EXAMPLE 1

An aqueous electrolytic bath was prepared containing per liter 28 grams of cadmium sulfate, 8 percent by volume of 66° Baume sulfuric acid, 3.75 grams of "Tetronic" 504 and 2.25 grams of "Lomar" NCO. A smooth, fine-grained, uniform dull semi-bright cadmium deposit was obtained on the Hull panel over a current density range of 0.01 to 8.0 amperes per square decimeter.

EXAMPLE 2

A bath was prepared as per Example 1 with the exception that 0.3 gram per liter of benzoylpyridine was added to the bath. The cadmium deposit was fully bright from current densities of 0.01 to 4.0 amperes per square decimeter, and from 4.0 to 8.0 amperes per square decimeter the deposit was bright with slightly hazy strips noted.

EXAMPLE 3

An aqueous bath was prepared containing per liter 39 grams of cadmium sulfate, 8 percent by volume of 66° Baume sulfuric acid, 3.75 grams of "Tetronic" 504, 2.25 grams of "Lomar" NCO, 0.3 gram of benzoylpyridine and 0.28 gram of orthochlorobenzaldehyde. The deposit was bright at current densities ranging from 0.1 to 4.0 amperes per square decimeter.

EXAMPLE 4

An aqueous bath was prepared containing per liter 39 grams of cadmium sulfate, 8 percent by volume of 66° Baume sulfuric acid, 4.0 grams of "Ethomeen" C-25, 0.9 gram of "Polyrad" 1110, 3.8 grams of "DuPonol" SN, 0.1 gram of betanaphthol, 0.375 gram of nicotinic acid and 0.28 gram of orthochlorobenzaldehyde. Bright cadmium deposits were obtained over current densities ranging from 1.6 to 8.0 amperes per square decimeter.

EXAMPLE 5

An aqueous electroplating bath was prepared containing per liter 39 grams of cadmium sulfate, 5 percent by volume 66° Baume sulfuric acid, 1.1 grams of "Polyrad" 1110, 1.1 grams of "Lomar" NCO, 3.7 grams of "DuPonol" 80, 0.37 gram of nicotinic acid and 0.28 gram of orthochlorobenzaldehyde. A bright cadmium deposit was obtained on the Hull panel at current densities ranging from 0.4 to 8 amperes per square decimeter.

EXAMPLE 6

A condensate was prepared by mixing 1.4 grams of amino guanidine bicarbonate with 1.8 grams of ethyl vanillin in 100 ml of "Cellosolve" and 50 ml water. To this solution was added 5 ml of 60° Baume sulfuric acid and the solution was stirred overnight at 70° C.

An aqueous bath was prepared containing per liter 30 grams of cadmium oxide, 2.5 percent by volume of 66° Baume sulfuric acid, 10 percent by volume of fluoboric acid (47 percent by weight aqueous solution), 3.5 grams of "Ethomeen" T/25, 60 grams of "Lomar" NCO and 15 ml of the condensate solution.

Utilizing a 2-ampere panel for 5 minutes, a fully bright cadmium deposit was obtained at current densities of from 0.10 to 6.0 amperes per square decimeter.

EXAMPLE 7

An aqueous bath was prepared containing per liter 30 grams of cadmium oxide, 2.5 percent by volume of 66° Baume sulfuric acid, 10 percent by volume of fluoboric acid (47 percent by weight aqueous solution), 3.5grams of "Ethomeen" T/25, 7.5 grams of "DuPonol" 80 and 22 ml of the condensate solution of Example 6. Utilizing a 2-ampere panel for 5 minutes, a fully bright deposit was obtained at current densities of from 0.01 to 2.0 amperes per square decimeter and a semi-bright deposit was obtained from 2.0 to 6.0 amperes per square decimeter.

What is claimed is:

1. An aqueous electroplating bath for depositing cadmium comprising about 5 to about 75 grams per liter of cadmium ion, a free acid selected from the group consisting of sulfuric acid, fluoboric acid or mixtures thereof, the concentration of said free acid being from about 0.4N to about 4.0N, and a surfactant combination comprising about 0.5 to about 20.0 grams per liter of a cationic polyoxyalkylated amine and from about 0.5 to about 10.0 grams per liter of an anionic surfactant.

2. The bath of claim 1 additionally containing from about 0.05 to about 2.0 grams per liter of at least one non-sulfur containing organic brightening compound.

3. The bath of claim 2 wherein said organic brightening compound is selected from the group consisting of aryl aldehydes, ring-halogenated aryl aldehydes, heterocyclic aldehydes, aryl olefinic-conjugated ketones and heterocyclic carboxylic acids.

4. The bath of claim 2 wherein said brightener compound is benzoylpyridine.

5. The bath of claim 2 wherein said brightener compound is a mixture of aminoguanidine bicarbonate and an aryl aldehyde.

6. The bath of claim 5 wherein said aryl aldehyde is selected from the group consisting of veratraldehyde, glutar aldehyde, ethyl vanillin and tolyl aldehyde.

7. The bath of claim 1 wherein said anionic surfactant is selected from the group consisting of condensed naphthalene sulfonic acids or salts thereof and alcohol sulfates having at least 8 carbon atoms.

8. The bath of claim 7 wherein said condensed naphthalene sulfonic acid or salt thereof is the sodium salt of condensed naphthalene sulfonic acid.

9. The bath of claim 7 wherein said condensed naphthalene sulfonic acid or salt thereof has a molecular weight of from about 400 to about 1200.

10. A method for electroplating cadmium comprising the steps of:

a. preparing an aqueous bath comprising about 5 to about 75 grams per liter of cadmium ion, a free acid selected from the group consisting of sulfuric acid, fluoboric acid or mixtures thereof, the concentration of said free acid being from about 0.4N to about 4.0N and a surfactant combination comprising about 0.5 to about 20.0 grams per liter of a cationic polyoxyalkylated amine and from about 0.5 to about 10.0 grams per liter of an anionic surfactant;

b. maintaining said bath at a temperature of from about 15° to about 35° C;

c. immersing a work piece having a metallic surface and a cadmium anode in said bath; and d. applying a voltage across said work piece and anode to thereby cause deposition of cadmium on said metallic surface.

11. The method of claim 10 wherein said bath additionally contains at least one non-sulfur containing organic brightener compound.

12. The method of claim 11 wherein said organic brightening compound is selected from the group consisting of aryl aldehydes, ring-halogenated aryl aldehydes, heterocyclic aldehydes, aryl olefinic-conjugated ketones and heterocyclic carboxylic acids.

13. The method of claim 10 wherein said anionic surfactant is selected from the group consisting of condensed naphthalene sulfonic acids or salts thereof and alcohol sulfates having at least 8 carbon atoms.

* * * * *